US007210390B1

(12) United States Patent
Olson et al.

(10) Patent No.: US 7,210,390 B1
(45) Date of Patent: May 1, 2007

(54) BUOYANCY DEVICE FOR PERSONNEL PROTECTIVE PLATES

(75) Inventors: John Olson, Phoenix, AZ (US); Jeffrey A. Mears, Chandler, AZ (US); Rob Monks, Chandler, AZ (US); P. Victor Kelsey, Chandler, AZ (US)

(73) Assignee: Simula, Inc., Phoenix, AZ (US)

( * ) Notice: Subject to any disclaimer, the term of this patent is extended or adjusted under 35 U.S.C. 154(b) by 25 days.

(21) Appl. No.: 11/063,835

(22) Filed: Feb. 23, 2005

(51) Int. Cl.
*F41H 1/02* (2006.01)

(52) U.S. Cl. ..... 89/36.05; 2/2.5; 428/911

(58) Field of Classification Search ..... 89/36.05, 89/36.02; 2/2.5; 428/911
See application file for complete search history.

(56) References Cited

U.S. PATENT DOCUMENTS

| | | | | | |
|---|---|---|---|---|---|
| 2,517,615 | A | * | 8/1950 | Webster et al. | 2/2.5 |
| 3,398,406 | A | * | 8/1968 | Waterbury | 2/2.5 |
| 4,716,810 | A | * | 1/1988 | DeGuvera | 89/36.02 |
| 4,833,729 | A | * | 5/1989 | Fox et al. | 441/102 |
| 4,864,656 | A | | 9/1989 | Nesse | |
| 5,060,314 | A | | 10/1991 | Lewis | |
| 5,149,910 | A | * | 9/1992 | McKee | 89/36.02 |
| 5,584,737 | A | * | 12/1996 | Luhtala | 441/107 |
| 5,996,115 | A | * | 12/1999 | Mazelsky | 2/2.5 |
| 6,012,162 | A | | 1/2000 | Bullat | |
| 6,029,270 | A | * | 2/2000 | Ost et al. | 2/2.5 |
| 6,070,274 | A | | 6/2000 | van der Sleesen | |
| 6,148,447 | A | * | 11/2000 | Bain et al. | 2/456 |
| 6,219,852 | B1 | * | 4/2001 | Bain et al. | 2/456 |
| 6,235,661 | B1 | * | 5/2001 | Khanamirian | 442/223 |
| 6,681,399 | B1 | * | 1/2004 | Kerr | 2/2.5 |
| 6,892,392 | B2 | * | 5/2005 | Crye et al. | 2/2.5 |

FOREIGN PATENT DOCUMENTS

| | | | |
|---|---|---|---|
| GB | 2333223 A | * | 7/1999 |
| WO | WO 00/51454 | | 9/2000 |

* cited by examiner

*Primary Examiner*—Michael J. Carone
*Assistant Examiner*—Bret Hayes
(74) *Attorney, Agent, or Firm*—Paul Hastings Janofsky & Walker; Aslan Baghdadi, Esq.

(57) ABSTRACT

A personal ballistic protective device having a first layer comprised of ballistic material and a second layer comprised of buoyant material. The second layer preferably has a density sufficient to counteract a density of at least the first layer of ballistic material such that the first layer and the second layer have a combined density substantially equal to or less than the density of water. A method of counteracting negative buoyancy in a personal protective device is also disclosed.

46 Claims, 3 Drawing Sheets

BUOYANCY DEVICE FOR PERSONNEL PROTECTIVE PLATES

BACKGROUND

1. Field of the Invention

The present invention relates generally to personnel protective vests and ballistic plates associated therewith. More specifically, the present invention relates to providing personnel protective plates having enhanced buoyancy characteristics.

2. Background of the Invention

Pilots and other personnel on aircraft and other vessels and elsewhere often wear vests containing bullet resistant inserts for protection against dangers such as small arms threats and explosive fragments, etc. These inserts are often made of ceramic or hard-faced metals in combination with fiber-reinforced plastics, among other materials.

While reinforced plastics often have a density near that of water (approximately 1 g/cc) and are therefore virtually neutral with regard to buoyancy, the ceramics often have a density ranging from approximately 2.5 to approximately 4.0 g/cc. Metal plates are often even denser and fall into a density range of approximately 4.5 to approximately 8.5 g/cc. The previously mentioned densities are intended only to provide exemplary density ranges of some common materials. One of skill in the art will recognize that many different materials may be used in the construction of such ballistic plates and that such densities may fall outside of the stated ranges, and that the present invention relates to any material used that has a density near to or greater than that of water.

In cases where the personnel are forced to exit the aircraft or vessel or otherwise enter water, the plates may become a liability resulting from, for example, the negative buoyancy associated therewith. The plates under this set of circumstances could become an additional force pulling the personnel beneath the water. Due to such a liability, personnel may choose not to wear the insert during combat near water. Alternatively, personnel may choose to discard the insert or even the entire vest upon entering the water. In either situation, the personnel may be faced with choosing between ballistic protection by keeping the plate and increased buoyancy by discarding the plate. Neither of these situations is optimal.

BRIEF SUMMARY OF THE INVENTION

According to one aspect, the invention includes a personal ballistic protective device having a first layer comprised of ballistic material and a second layer comprised of buoyant material. The second layer preferably has a density sufficient to counteract a density of at least the first layer of ballistic material such that the first layer and the second layer have a combined density substantially equal to or less than the density of water.

According to another aspect, the invention includes a personal ballistic protective device having a first layer comprising ballistic material having a first density and a second layer comprising buoyant material having a second density. The first density preferably is sufficient to counteract at least the second density such that the first layer and the second layer have a combined density substantially equal to or less than the density of water.

According to yet another aspect, the invention includes a method of counteracting negative buoyancy of a personal ballistic protective device. The method includes obtaining a ballistic first layer having a first density and obtaining a positive buoyancy second layer having a second density. The method further includes combining at least the first layer with the second layer to create a personal ballistic protective device such that the second density counteracts at least the first density.

DETAILED DESCRIPTION OF THE INVENTION

Figure 1:
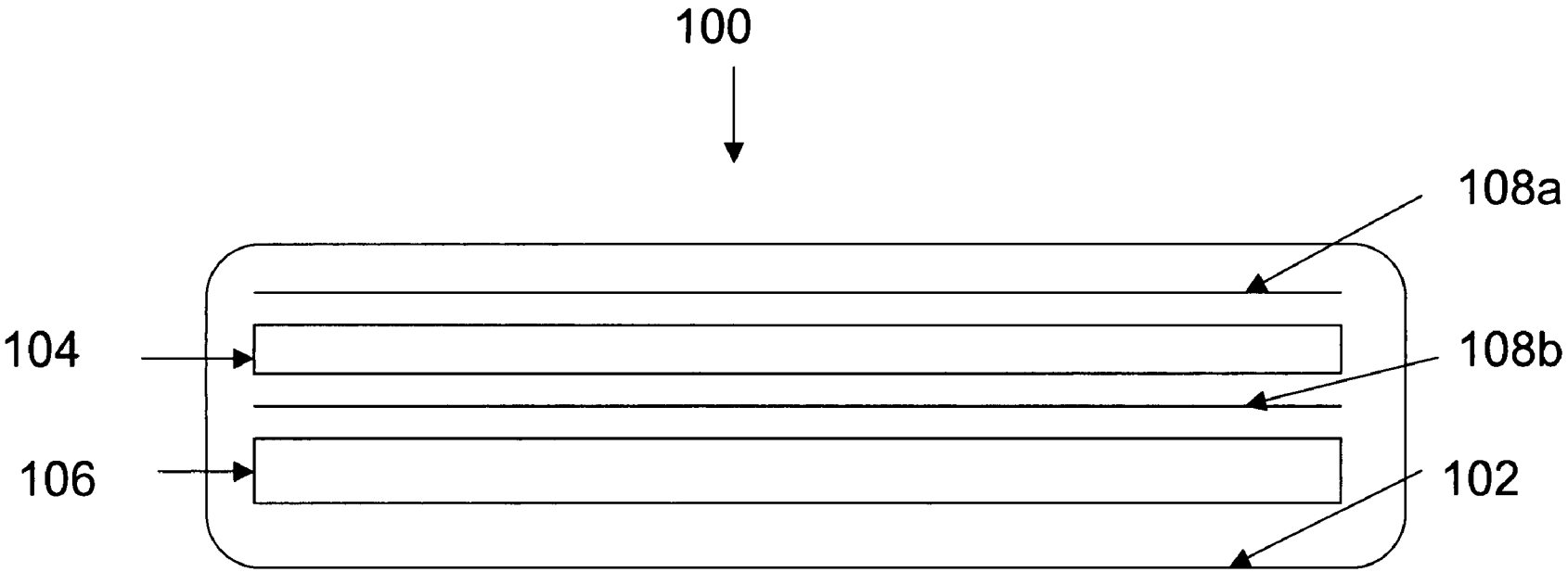
FIGURE 1 (PRIOR ART)
FIG. 1 is a cross-sectional view of a prior art vest having a ballistic plate and a fiber-based composite backing.

As seen in FIG. 1, a cross-section of a typical ballistic armor insert 100 includes an outer cover 102, a ballistic plate 104, a backing layer 106 and two high strength cloth layers 108*a* and 108*b*. As described above, ballistic plate 104 is often made of a material, such as a ceramic or metal, that has a high density, therefore causing insert 100 to have a density greater than that of water. As used herein, density of water typically refers to the standard value of 1 g/cc, but one of skill in the art will understand that the invention may be applied to specific situations where the density of water is not 1 g/cc. For example, salt water is denser than pure water and as such, the present invention may be modified for strictly saltwater applications so that the buoyancy of the personnel protective may be lower, but still more buoyant than or equally as buoyant as saltwater. By having such a density, the above-referenced and other problems may be encountered by users of insert 100.

Figure 2:
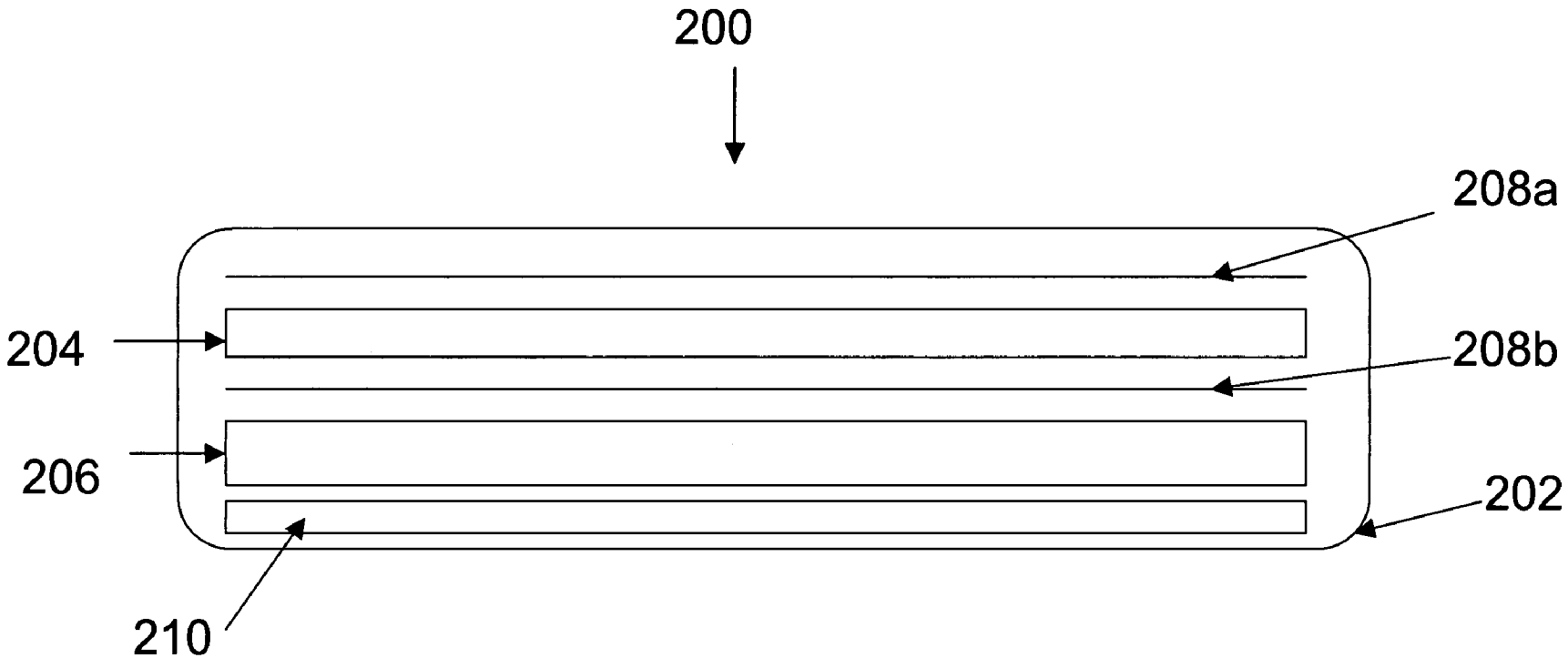
FIG. 2 is a cross-sectional view of a ballistic vest according to a first exemplary embodiment of the present invention.

FIG. 2 is a cross-section of an exemplary ballistic armor insert 200. As with armor insert 100, insert 200 includes an outer cover 202, a ballistic plate 204, a backing layer 206 and two high strength cloth layers 208*a* and 208*b* (although it may be desirable to have no cloth layer, only one cloth layer, or more than two cloth layers as well), but also includes a buoyancy layer 210. Outer cover 202 may be made of, for example, nylon, that substantially encloses inner portions 204–210. Ballistic plate 204 may be made of, for example, ceramic material, hard-faced metals, fiber-reinforced plastics (e.g. KEVLAR™), or any combination thereof. Adjacent to high strength layer 208*b*, is a backing layer 206 that may be, for example, a fiber-based composite backing that is added to further strengthen insert 200. Adjacent to backing layer 206, buoyancy layer 210 is included to cause the overall density of insert 200 to be substantially equal to or less than the density of water. In this manner, insert 200 may avoid many of the drawbacks associated with prior art inserts that have higher densities.

Buoyancy layer 210 may be comprised of a layer of closed-cell material with a high degree of inherent buoyancy, and may be preferably comprised of a lightweight foam-like structure made from materials such as, for example, polyethylene, polyurethane, polyesters, polyvinyls, other polymeric materials, natural or synthetic rubber, or other organic polymers. Buoyancy layer 210 may also be comprised of a fabricated "bubble-wrap" type structure, or similar enclosed air cellular component, Styrofoam layers, or combinations of any of the above-described materials with closed cell foams.

As mentioned above, the purpose of layer 210 is to offset the negative buoyancy of the rest of insert 200. Whatever the material used for layer 210, it will need to substantially offset at least the density of the ceramic or hard-faced metal that comprises a typical protective plate insert. The thickness of a required foam layer associated with an insert having a ceramic plate may be substantially estimated by the formula:

$$\text{Thickness of Foam} = \text{Thickness of Ceramic Plate} \times ((\rho\text{Ceramic}/\rho\text{Water}) - 1)$$

where ρ=density in g/cc.

The weight of the buoyancy layer can range from very light weight (~0.1 psf) up to approximately 0.5 to approximately 0.8 psf (or any other weight that suitably counteracts the density of the ballistic plate or the rest of the insert). The layer or layers of buoyant material may also provide an additional benefit of providing a blunting of the ballistic impact via shock wave dispersion of the foam cells. Such dispersion could mitigate trauma often associated with non-penetrating projectile impacts (blunt force trauma).

Unlike prior art devices, buoyancy layer 210 actually alters the buoyancy characteristics of armor insert 200 itself rather than including, for example, the addition of inflation devices or other buoyant components to the vest to make the entire vest assembly more buoyant. The degree of buoyancy may be controlled by thickness or size of the passive buoyant layer. Another advantage of the present invention is that it does not require any significant alteration of the overall vest assembly, thus allowing current vests to be used with the improved insert 200. Additionally, unlike prior art solutions, insert 200 does not require any active components, such as gas canisters, to provide buoyancy for the insert. Because insert 200 has an approximately positive buoyancy, the plate need not be removed from the vest assembly upon entry into the water as with prior art inserts. Also, personnel may maintain substantially the same, if not better, degree of ballistic protection as afforded by prior art plate/vest assemblies.

Figure 3:
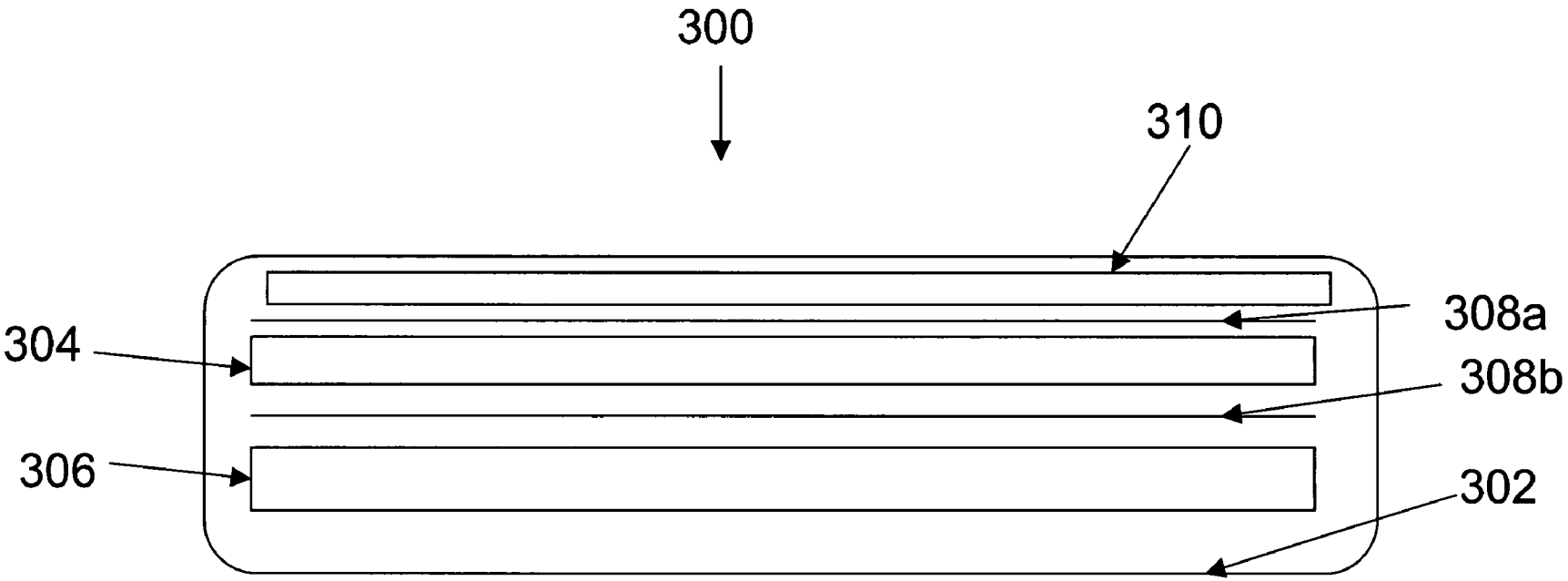
FIG. 3 is a cross-sectional view of a ballistic vest according to a second exemplary embodiment of the present invention.

Another alternative, exemplary embodiment of an armor insert 300 cross-section according to the present invention is depicted in FIG. 3. Insert 300 includes outer cover 302 enclosing layers similar to that of insert 200, except that the placement of the components is slightly altered. As with insert 200, insert 300 includes a ballistic layer 304, a backing layer 306 and two cloth layers 308*a* and 308*b*. Insert 300 also includes a buoyancy layer 310, but instead of being adjacent to the backing layer 308, as is done with insert 200, layer 310 is on the opposite side of insert 300 adjacent cloth layer 308*a*. One of skill in the art will understand that the various layers, including the buoyancy layer, may be in any configuration that provides suitable ballistic protection along with the desired buoyancy characteristics described herein.

An armor insert as described herein may be made by several methods, some exemplary ones of which are described below. For example, a layer (or layers) of buoyant material may be attached to the front (or back, or both) surface(s) of a manufactured insert. This assembly may be achieved, for example, by use of a film contact adhesive applied between the insert and the buoyant layer. Liquid adhesives, as well as any other suitable securing mechanism device or method, may also be used to bond the two components.

According to another exemplary method, the buoyancy layer may be included as a part of the interior insert assembly, as depicted in FIGS. 2 and 3. In other words, the buoyancy layer would be internal to the final fabricated insert assembly, and would be interior to the final outer containment (e.g., a ballistic nylon cover). In yet another method, a cavity in may be built into insert. Foam may then be injected into the cavity either before or during assembly. For example, with reference to FIG. 2, ballistic layer 204 may include a depression/cavity that can be filled with a buoyancy-providing foam or other similar material. Such a cavity or depression would preferably not significantly decrease the ballistic qualities of the insert.

In yet another method of construction, a separate, unattached foam layer may be inserted into the vest assembly either behind or in front of the insert to provide increased buoyancy to counteract any negative buoyancy of the insert. Additionally a cloth pocket may be provided on the insert to allow such a foam layer to be added to the insert. Such pocket may be included on either the front or the back of the insert.

An insert as described herein, preferably provides buoyancy to all levels of protective inserts, such as NIJ levels III and IV, as well as other plates designed against specific threats outside of the standard NIJ or other United States government designations.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A personal ballistic protective device, comprising:

a first layer comprised of ballistic material; and a second passive buoyant layer comprised of buoyant material having a density sufficient to counteract a density of at least the first layer of ballistic material such that the first layer and the second layer have a combined density substantially equal to or less than the density of water, wherein the first layer and the second layer each comprise a face having substantially the same surface area and a thickness of the second layer is approximately equal to a thickness of the first layer multiplied by the difference between the ratio of the density of the ballistic layer to the density of water and 1.

2. The personal ballistic protective device of claim 1, wherein the entire personal ballistic protective device has a density substantially equal to or less than the density of water.

3. The personal ballistic protective device of claim 1, further comprising a cover substantially enclosing the first and second layers.

4. The personal ballistic protective device of claim 1, further comprising a third backing layer.

5. The personal ballistic protective device of claim 4, wherein the backing layer comprises a fiber-based composite material.

6. The personal ballistic protective device of claim 1, wherein the ballistic material comprises at least one of a ceramic, a metal, and a fiber-based composite material.

7. The personal ballistic protective device of claim 1, wherein the buoyant material comprises closed cell material.

8. The personal ballistic protective device of claim 1, wherein the buoyant material comprises at least one of polyethylene, polyurethane, a polyester, a polyvinyl, and a natural or synthetic rubber.

9. The personal ballistic protective device of claim 1, wherein the first layer and the second layer each comprise a face having substantially the same surface area and:

$$\text{a thickness of the second layer} = \text{a thickness of the first layer} \times ((\rho\text{first layer}/\rho\text{Water}) - 1),$$

where ρ=density in g/cc.

10. The personal ballistic protective device of claim 1, wherein the device is insertable into a personnel vest.

11. A personnel vest comprising the personal ballistic protective device of claim 1.

12. A personal ballistic protective device, comprising:

a first layer comprising ballistic material having a first density; and a second passive buoyant layer comprising buoyant material having a second density, wherein the first density is sufficient to counteract at least the second density such that the first layer and the second layer have a combined density substantially equal to or less than the density of water, and wherein the first layer and the second layer each comprise a face having substantially the same surface area and a thickness of the second layer is approximately equal to a thickness of the first layer multiplied by the difference between the ratio of the density of the ballistic layer to the density of water and 1.

13. The personal ballistic protective device of claim 12, wherein the second density is such that an overall density of the entire personal ballistic protective device is equal to or less than the density of water.

14. The personal ballistic protective device of claim 12, further comprising a cover substantially enclosing the first and second layers.

15. The personal ballistic protective device of claim 12, further comprising a third backing layer.

16. The personal ballistic protective device of claim 15, wherein the backing layer comprises a fiber-based composite material.

17. The personal ballistic protective device of claim 12, wherein the ballistic material comprises at least one of a ceramic, a metal, and a fiber-based composite material.

18. The personal ballistic protective device of claim 12, wherein the buoyant material comprises closed cell material.

19. The personal ballistic protective device of claim 12, wherein the buoyant material comprises at least one of polyethylene, polyurethane, a polyester, a polyvinyl, and a natural or synthetic rubber.

20. The personal ballistic protective device of claim 12, wherein the first layer and the second layer each comprise a face having substantially the same surface area and:

$$\text{a thickness of the second layer} = \text{a thickness of the first layer} \times ((\rho\text{first layer}/\rho\text{Water}) - \text{I}),$$

where ρ=density in g/cc.

21. The personal ballistic protective device of claim 12, wherein the device is insertable into a personnel vest.

22. A method of counteracting negative buoyancy of a personal ballistic protective device, comprising:

obtaining a ballistic first layer having a first density;

obtaining a passive, positive buoyancy second layer having a second density; combining at least the first layer with the second layer to create a personal ballistic protective device, wherein the second density counteracts at least the first density, and wherein the first layer and the second layer each comprise a face having substantially the same surface area and a thickness of the second layer is approximately equal to a thickness of the first layer multiplied by the difference between the ratio of the density of the ballistic layer to the density of water and 1.

23. The method of claim 22, further comprising affixing the first layer to the second layer.

24. The method of claim 22, wherein the second density is such that an overall density of the entire personal ballistic protective device is equal to or less than the density of water.

25. A personal ballistic protective device, comprising:

a first layer comprised of ballistic material; and a second layer comprised of buoyant closed-cell material having a density sufficient to counteract a density of at least the first layer of ballistic material such that the first layer and the second layer have a combined density substantially equal to or less than the density of water, wherein the first layer and the second layer each comprise a face having substantially the same surface area and a thickness of the second layer is approximately equal to a thickness of the first layer multiplied by the difference between the ratio of the density of the ballistic layer to the density of water and 1.

26. The personal ballistic protective device of claim 25, wherein the entire personal ballistic protective device has a density substantially equal to or less than the density of water.

27. The personal ballistic protective device of claim 25, further comprising a cover substantially enclosing the first and second layers.

28. The personal ballistic protective device of claim 25, further comprising a third backing layer.

29. The personal ballistic protective device of claim 28, wherein the backing layer comprises a fiber-based composite material.

30. The personal ballistic protective device of claim 25, wherein the ballistic material comprises at least one of a ceramic, a metal, and a fiber-based composite material.

31. The personal ballistic protective device of claim 25, wherein the buoyant material comprises at least one of polyethylene, polyurethane, a polyester, a polyvinyl, and a natural or synthetic rubber.

32. The personal ballistic protective device of claim 25, wherein the first layer and the second layer each comprise a face having substantially the same surface area and:

$$\text{a thickness of the second layer} = \text{a thickness of the first layer} \times ((\rho\text{first layer}/\rho\text{Water}) - 1),$$

where ρ=density in g/cc.

33. The personal ballistic protective device of claim 25, wherein the device is insertable into a personnel vest.

34. A personnel vest comprising the personal ballistic protective device of claim 25.

35. A personal ballistic protective device, comprising:

a first layer comprising ballistic material having a first density; and a second layer comprising buoyant closed-cell material having a second density, wherein the first density is sufficient to counteract at least the second density such that the first layer and the second layer have a combined density substantially equal to or less than the density of water, wherein the first layer and the second layer each comprise a face having substantially the same surface area and a thickness of the second layer is approximately equal to a thickness of the first layer multiplied by the difference between the ratio of the density of the ballistic layer to the density of water and 1.

36. The personal ballistic protective device of claim 35, wherein the second density is such that an overall density of the entire personal ballistic protective device is equal to or less than the density of water.

37. The personal ballistic protective device of claim 35, further comprising a cover substantially enclosing the first and second layers.

38. The personal ballistic protective device of claim 35, further comprising a third backing layer.

39. The personal ballistic protective device of claim 38, wherein the backing layer comprises a fiber-based composite material.

40. The personal ballistic protective device of claim 35, wherein the ballistic material comprises at least one of a ceramic, a metal, and a fiber-based composite material.

41. The personal ballistic protective device of claim 35, wherein the buoyant, material comprises at least one of polyethylene, polyurethane, a polyester, a polyvinyl, and a natural or synthetic rubber.

42. The personal ballistic protective device of claim 35, wherein the first layer and the second layer each comprise a face having substantially the same surface area and:

$$\text{a thickness of the second layer} = \text{a thickness of the first layer} \times ((\rho_{\text{first layer}}/\rho_{\text{water}}) - 1),$$

where $\rho$=density in g/cc.

43. The personal ballistic protective device of claim 35, wherein the device is insertable into a personnel vest.

44. A method of counteracting negative buoyancy of a personal ballistic protective device, comprising:

obtaining a ballistic first layer having a first density;

obtaining a positive buoyancy closed-cell second layer having a second density;

combining at least the first layer with the second layer to create a personal ballistic protective device, wherein the second density counteracts at least the first density, and wherein the first layer and the second layer each comprise a face having substantially the same surface area and a thickness of the second layer is approximately equal to a thickness of the first layer multiplied by the difference between the ratio of the density of the ballistic layer to the density of water and 1.

45. The method of claim 44, further comprising affixing the first layer to the second layer.

46. The method of claim 44, wherein the second density is such that an overall density of the entire personal ballistic protective device is equal to or less than the density of water.

* * * * *